US010246891B2

(12) United States Patent
Huang

(10) Patent No.: US 10,246,891 B2
(45) Date of Patent: Apr. 2, 2019

(54) SHEATHED FRAME POOL

(71) Applicant: BESTWAY INFLATABLES & MATERIAL CORP., Shanghai (CN)

(72) Inventor: Shuiyong Huang, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 15/391,481

(22) Filed: Dec. 27, 2016

(65) Prior Publication Data

US 2017/0356206 A1 Dec. 14, 2017

(30) Foreign Application Priority Data

Jun. 8, 2016 (CN) ..... 2016 2 0554727 U

(51) Int. Cl.
*E04H 4/00* (2006.01)

(52) U.S. Cl.
CPC ..... *E04H 4/0056* (2013.01)

(58) Field of Classification Search
CPC ..... E04H 4/0025
USPC ..... 4/506–512
See application file for complete search history.

(56) References Cited

U.S. PATENT DOCUMENTS

| | | | | |
|---|---|---|---|---|
| 4,356,933 | A | 11/1982 | Connolly | |
| 5,083,327 | A * | 1/1992 | Gillebaard | E04H 4/0056 220/4.16 |
| 5,592,702 | A * | 1/1997 | Gillebaard, Jr. | E04H 4/0056 4/506 |
| 5,943,709 | A | 8/1999 | Chiu | |
| 6,604,250 | B1 * | 8/2003 | Lee | E04H 4/0056 4/506 |
| 7,188,747 | B2 | 3/2007 | Bennett et al. | |
| 2001/0037620 | A1 | 11/2001 | Choi | |

* cited by examiner

*Primary Examiner* — Lori Baker
(74) *Attorney, Agent, or Firm* — AJ Moss; Dickinson Wright PLLC

(57) ABSTRACT

A sheathed frame includes a support frame comprised of a plurality of interconnected support components, a pool liner comprising a pool bottom and a pool wall connected to an outer edge of the pool bottom and extending upward, an upper edge of said pool wall hanging on said support frame and disposed on an inside of said support frame, and at least one sheath disposed on a junction between at least two of said plurality of interconnected support components. Sheaths are respectively provided at the junction of a horizontal side pipe and a T-shaped pipe joint of the frame pool and the junction of a support pipe and the T-shaped pipe joint.

14 Claims, 12 Drawing Sheets

SHEATHED FRAME POOL

CROSS REFERENCE

This application claims the benefit and priority of Chinese Application No. 201620554727.9, filed Jun. 8, 2016. The entire disclosures of each of the above applications are incorporated herein by reference.

FIELD OF THE INVENTION

The present invention relates to an above ground pool, in particular to a sheathed frame pool.

BACKGROUND

In the field of pools, there are various above ground pools, including frame pools.

FIG. 1 is a structural view of a frame pool. As shown in FIG. 1, the frame pool in the prior art generally comprises a horizontal side pipe 10 made of steel pipes, a support pipe 20, a T-shaped pipe joint 30 connecting the horizontal side pipe 10 and the support pipe 20, and a pool liner 40.

The horizontal side pipe 10 and the support pipe 20 are both assembled into one piece by inserting an end portion into the T-shaped pipe joint 30. In order to achieve the purpose of rust prevention, the outer surfaces of the horizontal side pipe 10, the support pipe 20 and the T-shaped pipe joint 30 are generally provided with an anti-rust coating such as an epoxy resin, a paint, etc. In the process of inserting the horizontal edge pipe 10 and the support pipe 20 into the T-shaped pipe joint 30, the anti-rust coating is susceptible to damage due to mutual frictions, such that the horizontal side pipe 10, the support pipe 20 and the T-shaped pipe joint 30 get rusted.

During the use of the frame pool, the shaking of the pool will also generate frictions at the junction of the horizontal side pipe 10, the support pipe 20 and the T-shaped pipe joint 30 so as to damage an anti-rust coating.

In addition, after the horizontal side pipe 10 and the support pipe 20 are inserted into the T-shaped pipe joint 30, a gap exists there between, such that rainwater and the spilled water during the use of the pool may easily flow into the interior of the pipe body through the gap, which results in rust generation of the pipe body.

SUMMARY

The technical problem to be solved by the present invention is to overcome the defect of damaging the anti-rust coating owing to frictions easily generated at the junction of various components of the frame pool in the prior art, and a sheathed frame pool is provided.

The above-mentioned technical problem is solved by the following technical solution in the present invention: a sheathed frame pool, comprising:

a support frame comprising a plurality of interconnected support components;

a pool liner comprising a pool bottom and a pool wall connected to an outer edge of the pool bottom and extends upward, an upper edge of said pool wall being hanging on said support frame and being disposed on an inside of said support frame; and at least one sheath disposed on a junction between at least two of said plurality of interconnected support components.

Preferably, said plurality of interconnected support components comprise:

a plurality of horizontal side pipes, each of said horizontal side pipes having two ends, each of the two ends having a horizontal connecting portion;

a plurality of support pipes, an upper end of each of said support pipes having a vertical connecting portion; and a plurality of T-shaped pipe joints, each of the T-shaped pipe joints comprising a horizontal portion and a perpendicular portion, the horizontal portion comprising two ends, the perpendicular portion being disposed on a lower end of each T-shaped pipe joint and being connected to the horizontal portion;

wherein each horizontal side pipe is connected between the adjacent two T-shaped pipe joints to form a upper frame structure by the horizontal connecting portion being inserted into the horizontal portion;

wherein each support pipe is connected to each T-shaped pipe joint to support the upper frame structure by the vertical connecting portion being inserted into the perpendicular portion;

wherein the sheath is disposed on a horizontal junction of connecting the horizontal connecting portion and the horizontal portion and on a vertical junction of connecting the vertical connecting portion and the perpendicular portion, and a plurality of sleeves are disposed on a upper edge of the pool liner for disposing the pool liner on the upper frame structure.

Preferably, the sheath is at least partially disposed between an inner surface of the horizontal portion and an outer surface of the horizontal connecting portion.

Preferably, the sheath is at least partially disposed between an inner surface of the perpendicular portion and an outer surface of the vertical connecting portion.

Preferably, the sheathed frame pool further comprises at least one first fastened hole disposed on the horizontal connecting portion, at least one second fastened hole disposed on the vertical connecting portion, at least one third fastened hole disposed on the two ends of horizontal portion and the perpendicular portion respectively.

Preferably, said sheath comprises:

a sheath body, the sheath body being a hollow pipe structure; and at least one fourth fastened hole, the least one fourth fastened hole being disposed on a pipe wall of the sheath body.

Preferably, the sheathed frame pool further comprises at least one ring structure disposed on an outer surface of the sheath body.

Preferably, the sheathed frame pool further comprises an annular fixing ring disposed on an edge of the fourth fastened hole the annular fixing ring being extended inwardly on the fourth fastened hole, the annular fixing ring being at least partially inserted into the first fastened hole.

Preferably, the ring structure is an annular convex rib connected to the sheath body, the annular convex rib being higher than the outer surface of the sheath body.

Preferably, said ring structure is of an O-shaped ring.

Preferably, the outer surface of the sheath body comprises at least one annular groove, the O-shaped ring is at least partially embedded in the annular groove, and the O-shaped ring is disposed above the outer surface of the sheath body.

Preferably, a first end of said sheath body has a first annular limiting ring extending outwardly and connected to said outer surface of said sheath body.

Preferably, a second end of said sheath body has a second annular limiting ring extending inwardly and connected to an inner surface of said sheath body.

Preferably, said sheath comprises:

a sheath body, the sheath body being a hollow pipe structure; and an extension portion, an upper end of the extension portion being connected to a lower end of the sheath body, a size and width of the extension portion gradually increasing from an top side to bottom side of the extension portion Preferably, the sheath body comprises at least one fourth fastened hole being disposed on a pipe wall of the sheath body.

Preferably, the sheathed frame pool comprises a plurality of pins dispose on the interconnected support components, each of the pins being drilled through the first fastened hole, the third fastened hole and the fourth fastened hole to correspondingly fasten the horizontal side pipe, the T-shaped pipe joint and the sheath.

Preferably, the pins drill through the second fastened hole, the third fastened hole, and the fourth fastened hole to correspondingly fasten the horizontal side pipe, the T-shaped pipe joint and the sheath.

Preferably, each of the pins comprises:

a pin body, the pin body being cylinder, and comprising at least two branches disposed on a lower end of the pin body;

a cover disposed on a top portion of the pin body and comprising an edge extending outwardly; and a protrusion disposed on an outer side of the branches in tail ends.

Preferably, each of the pins comprises a bowl-shaped water retaining piece, the water retaining piece comprising a through hole, the pin body being inserted into the through hole, the bowl-shaped water retaining piece being disposed between the cover of the pin and an outer surface of the horizontal portion of the T-shaped pipe joint.

Preferably, the cross sections of the horizontal side pipes, the support pipes and the T-shaped pipe joints are one of a circular shape, an elliptical shape and a D shape.

The positive progressive effects of the present invention lie in:

the sheathed frame pool of the present invention has a simple structure, a low cost and convenient installation. Sheaths are respectively provided at the junction of a horizontal side pipe and a T-shaped pipe joint of the frame pool and the junction of a support pipe and the T-shaped pipe joint, which can effectively overcome the defect of rust generation on the pipe body caused by the susceptibility to wear of the coating at an outer surface of the horizontal side pipe and the support pipe due to frequent frictions between the horizontal side pipe and the T-shaped pipe joint and between the support pipe and the T-shaped pipe joint during the installation or use of frame pools in the prior art.

In addition, one or more ring structures are disposed on the sheath, which can stop water from flowing into the interior of the pipe body through gaps between the horizontal side pipe, the support pipe and the T-shaped pipe joint, which can effectively prevent the pipe body from generating rust, and can greatly prolong the service life of the frame pool.

BRIEF DESCRIPTION OF THE DRAWINGS

The above-mentioned and other features, characteristics and advantages of the present invention will be more apparent from the following description taken in conjunction with the accompanying drawings and embodiments, and in the accompanying drawings, like reference numbers indicate like features, in which.

DETAILED DESCRIPTION

Figure 1:
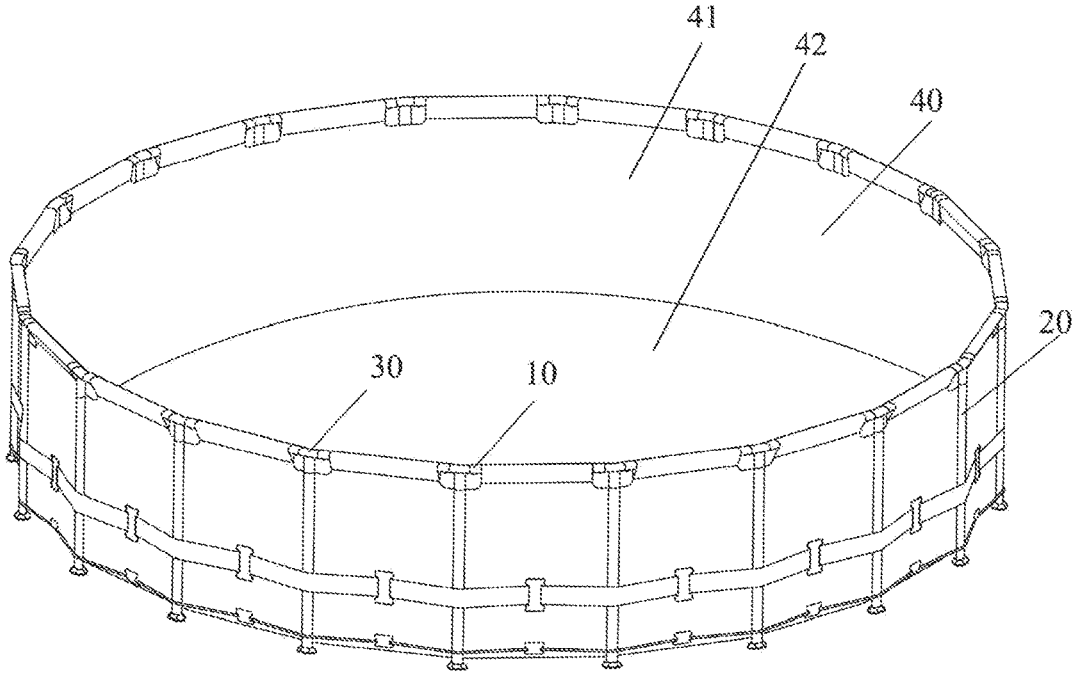
FIG. 1 is a structural schematic view of a frame pool.

To make the above-mentioned object, features and advantages of the present invention apparent and easily understood, a detailed description of particular embodiments of the present invention is made in conjunction with the drawings.

Embodiments of the present invention will now be described in detail with reference to the accompanying drawings. Reference now will be made in detail to preferred embodiments of the present invention, examples of which are illustrated in the accompanying drawings. The same reference numerals in all the figures denote the same or similar parts wherever possible. Furthermore, although the terms used in the present invention are selected from well-known common terms, some of the terms mentioned in the description of the present invention may be selected by the applicant according to his or her judgment, and the detailed meaning thereof is described in the relevant section described herein. Furthermore, the present invention must be understood, not simply by the actual terms used but also by the meanings encompassed by each term.

Embodiment I

Figure 2:
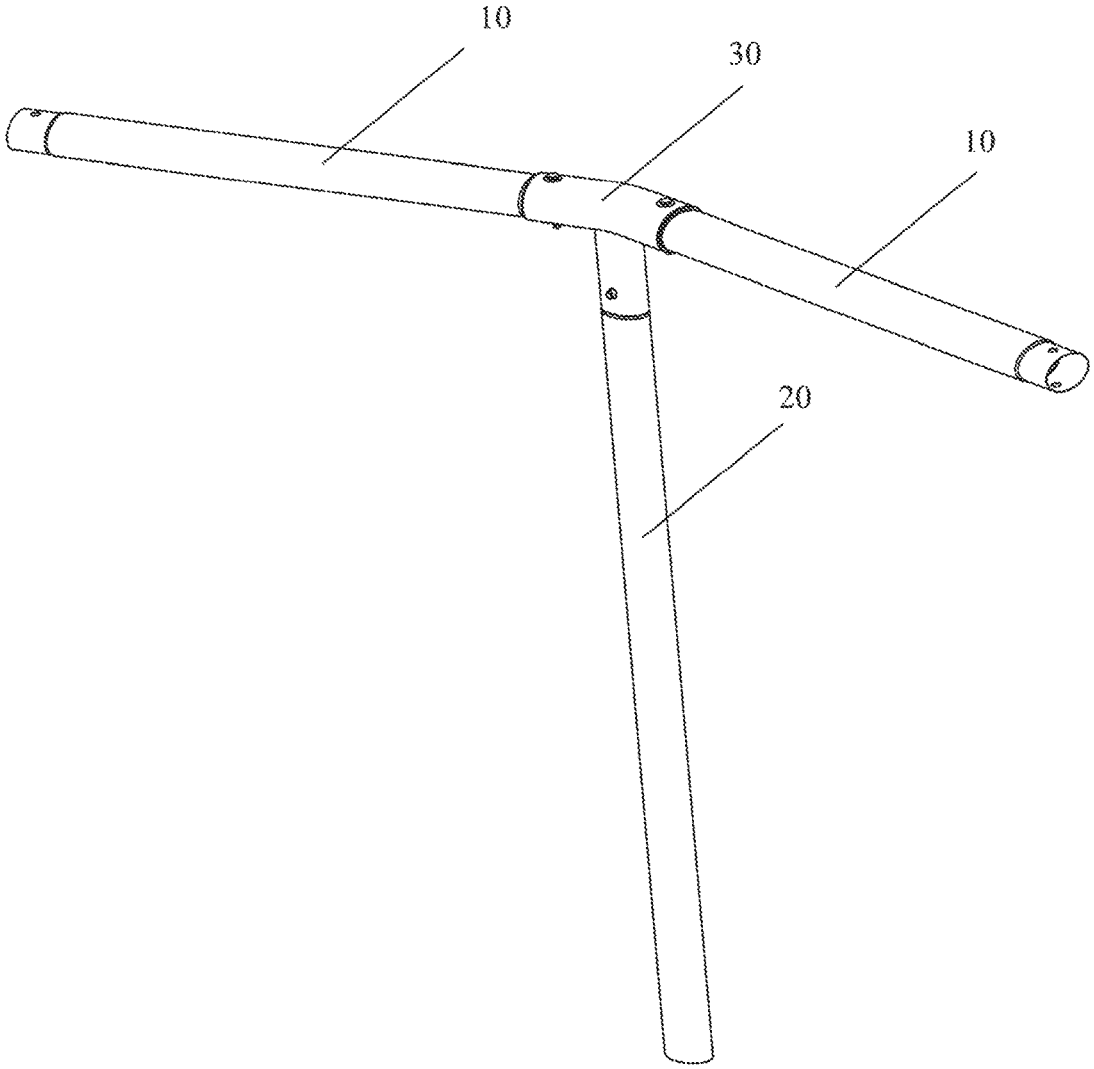
FIG. 2 is a first partial schematic view of a sheathed frame pool of the present invention after being assembled.
Figure 3:
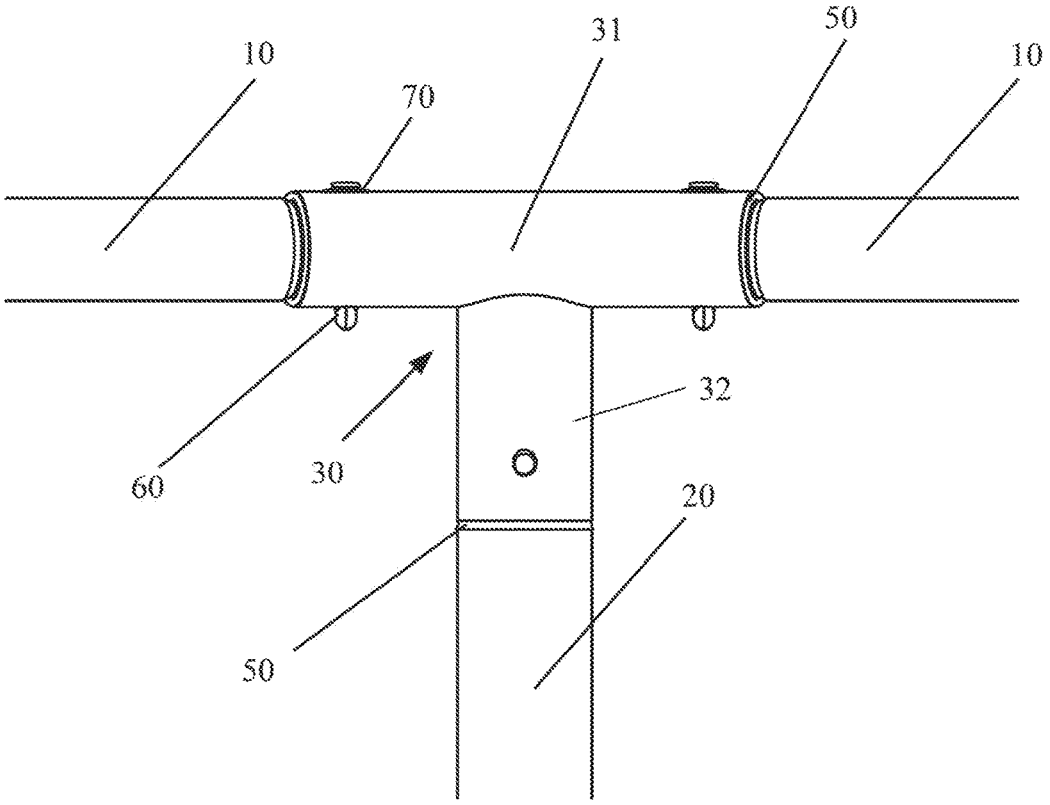
FIG. 3 is a second partial schematic view of a sheathed frame pool of the present invention after being assembled.
Figure 4:
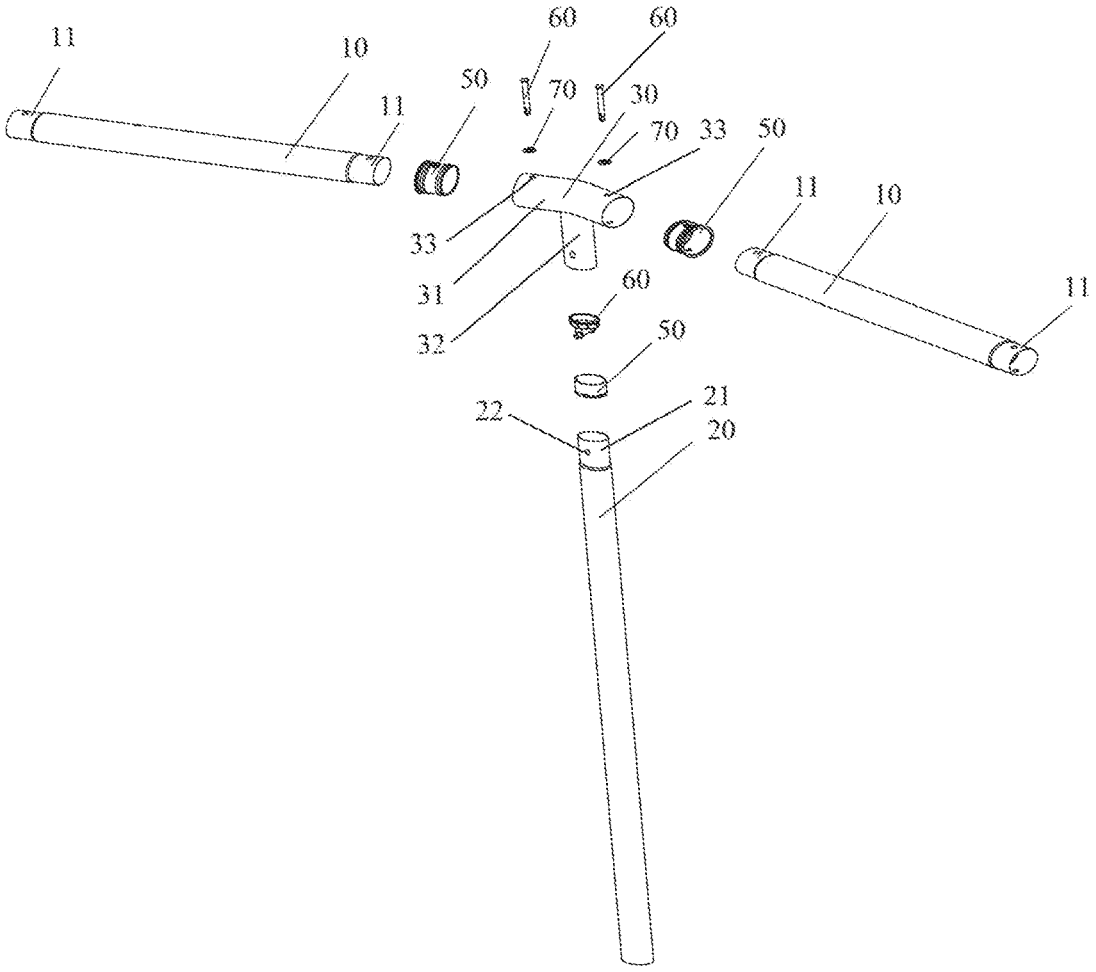
FIG. 4 is a first exploded schematic view of various components in a sheathed frame pool of the present invention.
Figure 5:
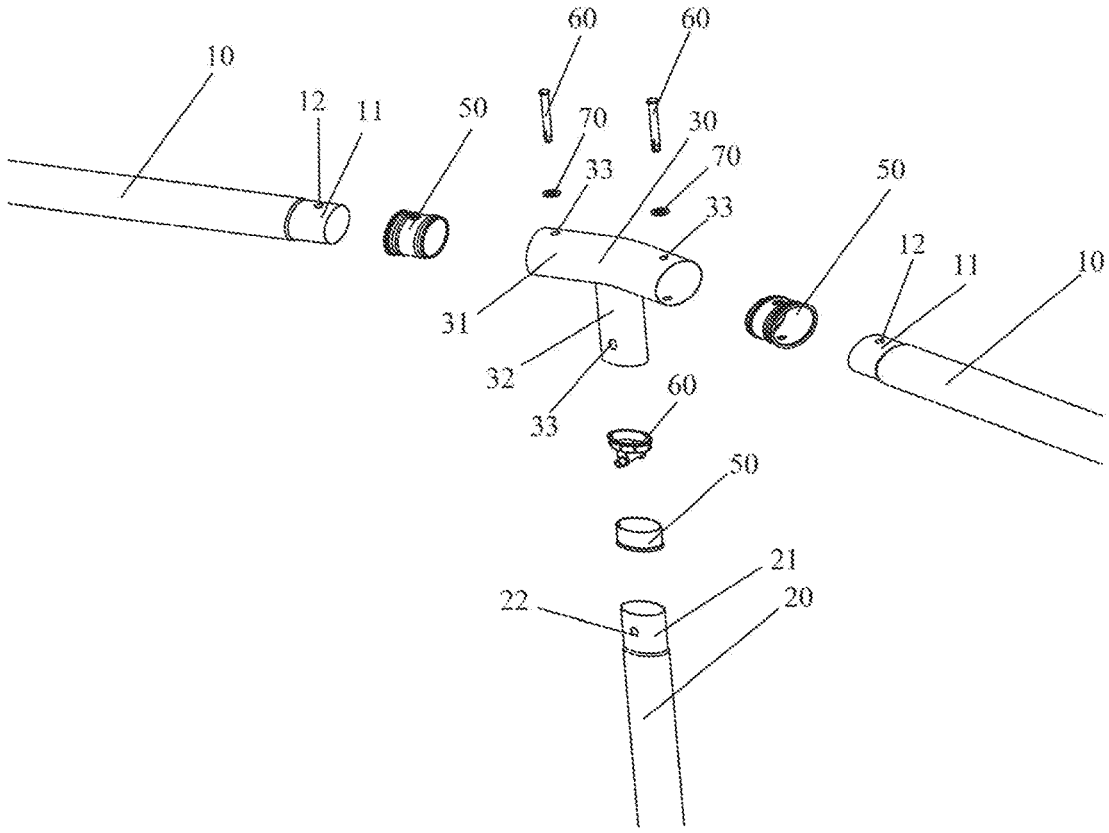
FIG. 5 is a second exploded schematic view of various components in a sheathed frame pool of the present invention.

FIG. 1 is a structural schematic view of a frame pool. FIG. 2 is a first partial schematic view of a sheathed frame pool of the present invention after being assembled. FIG. 3 is a second partial schematic view of a sheathed frame pool of the present invention after being assembled. FIG. 4 is a first exploded schematic view of the components in a sheathed frame pool of the present invention. FIG. 5 is a second exploded schematic view of the components in a sheathed frame pool of the present invention.

As shown in FIG. 1 to FIG. 5, the present invention discloses a sheathed frame pool, which comprises a support frame, a pool liner 40 and at least one sheath 50. Said support frame is composed of a plurality of interconnected support components. The pool liner 40 comprises a pool bottom 42 and a pool wall 41 which is connected to an outer edge of the pool bottom 42 and extends upward, an upper edge of the pool wall 41 hangs on said support frame and is disposed inside said support frame, and the sheath 50 is disposed at the junction of at least two said support components.

Preferably, said support component comprises a plurality of horizontal side pipes 10, a plurality of support pipes 20, and a plurality of T-shaped pipe joints 30. Two ends of each horizontal side pipe 10 are respectively provided with a connecting portion 11, and the upper end of each support pipe 20 is provided with a connecting portion 21. The T-shaped pipe joint 30 comprises a horizontal portion 31 and a perpendicular portion 32 connected to the horizontal portion 31.

The connecting portions 11 of a plurality of horizontal side pipes 10 are respectively inserted into two ends of the horizontal portion 31 of adjacent T-shaped pipe joints 30 so as to form a closed upper frame structure, the connecting portion 21 of the support pipe 20 is inserted into the lower end of the perpendicular portion 32 of the T-shaped pipe joint 30 so as to support said upper frame structure, the sheath 50 is disposed at the junction of the connecting portion 11 of the horizontal side pipe 10 and two ends of the horizontal portion 31 of the T-shaped pipe joint 30, and said plurality of horizontal side pipes are inserted into a plurality of sleeves at the upper side of said pool wall.

In addition, the sheath 50 is further disposed at the junction of the connecting portion 21 of the support pipe 20 and the lower end of the T-shaped pipe joint 30. The sheath 50 herein is at least partially disposed between an inner surface of two ends of the horizontal portion 31 of the T-shaped pipe joint 30 and an outer surface of the connecting portion 11 of the horizontal side pipe 10. The sheath 50 is at least partially provided between an inner surface at the lower end of the perpendicular portion 32 of the T-shaped pipe joint 30 and an outer surface of the connecting portion 21 of the support pipe 20.

More particularly, at least one first fixing hole 12 is provided at the connecting portion 11 of the horizontal side pipe 10, at least one second fixing hole 22 is provided at the connecting portion 21 of the support pipe 20, and at least one third fixing hole 33 is provided at two ends of the horizontal portion 31 of the T-shaped pipe joint 30 and the lower end of the perpendicular portion 32 of the T-shaped pipe joint 30.

Figure 6:
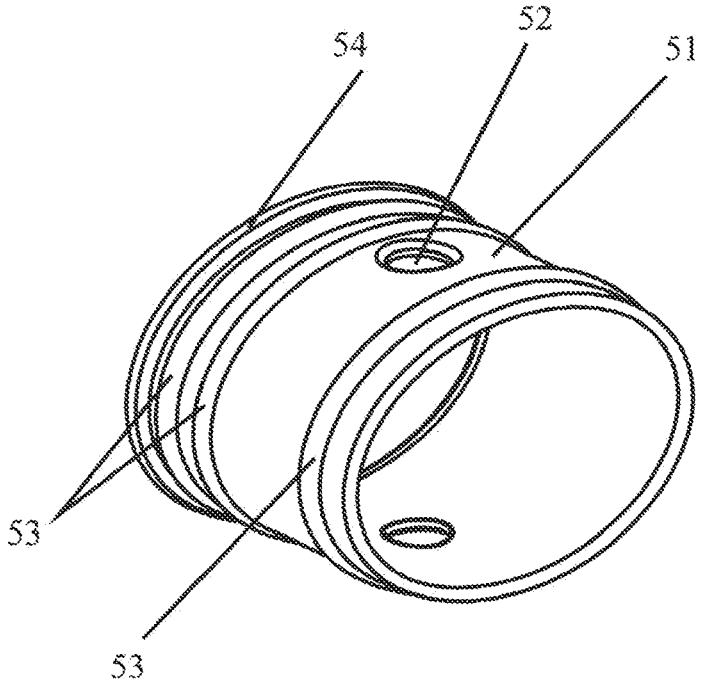
FIG. 6 is a perspective view of a sheath in embodiment I of a sheathed frame pool of the present invention.
Figure 7:
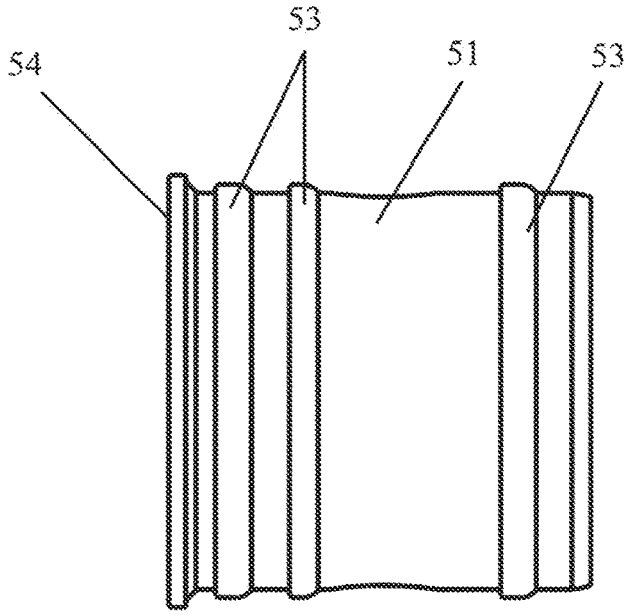
FIG. 7 is a front view of a sheath in embodiment I of a sheathed frame pool of the present invention.
Figure 8:
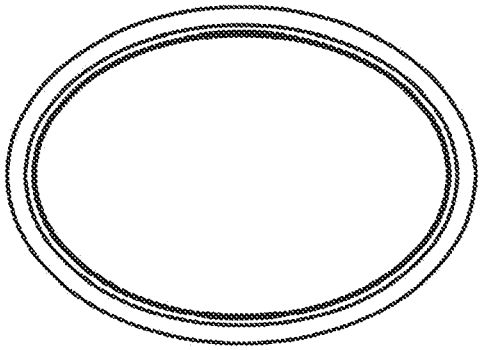
FIG. 8 is a right view of a sheath in embodiment I of a sheathed frame pool of the present invention.
Figure 9:
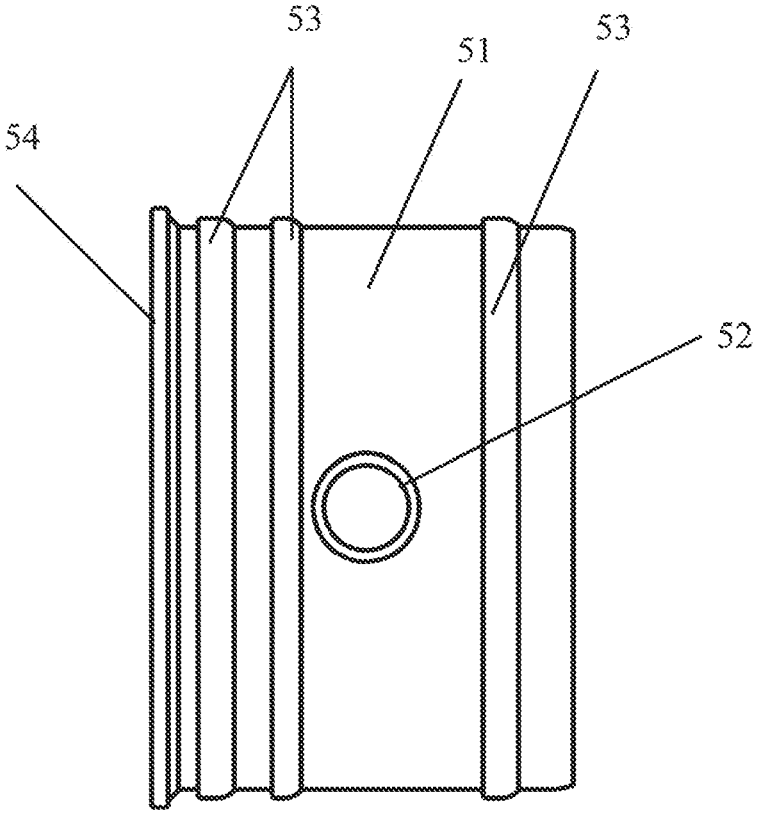
FIG. 9 is a top view of a sheath in embodiment I of a sheathed frame pool of the present invention.

FIG. 6 is a perspective view of a sheath in embodiment I of a sheathed frame pool of the present invention. FIG. 7 is a front view of a sheath in embodiment I of a sheathed frame pool of the present invention. FIG. 8 is a right view of a sheath in embodiment I of a sheathed frame pool of the present invention. FIG. 9 is a top view of a sheath in embodiment I of a sheathed frame pool of the present invention.

As shown in FIG. 6 to FIG. 9, the sheath 50 comprises a sheath body 51, the sheath body 51 is preferably configured to be of a hollow pipe structure, and at least one fourth fixing hole 52 is provided on the pipe wall of the sheath body 51.

Moreover, the sheath 50 further comprises at least one ring structure, and said at least one ring structure is provided at an outer surface of the sheath body 51. The edge of the fourth fixing hole 52 is provided with an annular fixing ring 521 extending outward, and said fixing ring 521 at least partially is inserted into an inner side of the first fixing hole 12. When the connecting portion 11 of the horizontal side pipe 10 is inserted into the sheath 50, the annular fixing ring 521 is embedded into the first fixing hole 12, which can prevent the sheath 50 from slipping or rotation.

Preferably, said ring structure uses a plurality of annular convex ribs 53, the annular convex ribs 53 are connected to the sheath body 51 and are above an outer surface of the sheath body 51, the annular convex ribs 53 can stop water from entering a gap between an outer surface of the connecting portion 11 of the horizontal side pipe 10 and an inner surface of the T-shaped pipe joint 30, thereby preventing the interior of the pipe body from getting rusted from moisture.

Figure 10:
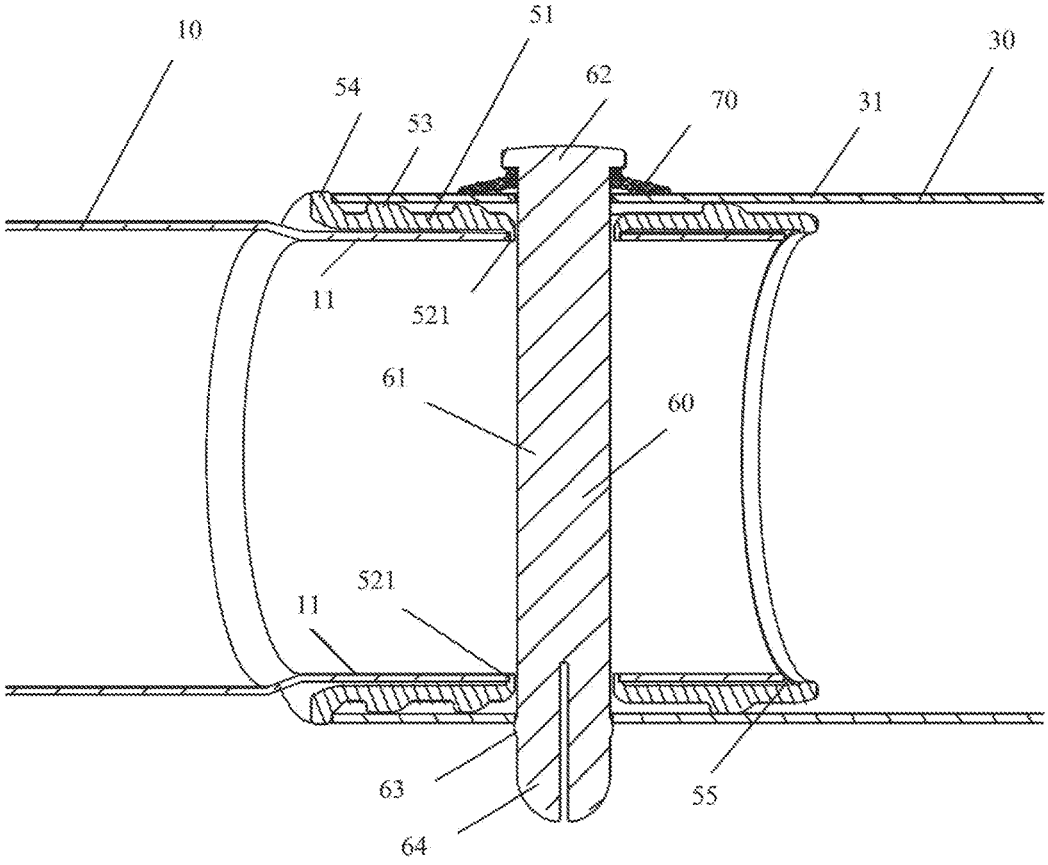
FIG. 10 is a sectional view of the junction of a horizontal side pipe and a T-shaped pipe joint in embodiment I of a sheathed frame pool of the present invention.

FIG. 10 is a sectional view of the junction of a horizontal side pipe and a T-shaped pipe joint in embodiment I of a sheathed frame pool of the present invention.

As shown in FIG. 10, said support component further comprises a plurality of pins 60, and the pins 60 are inserted, respectively, into a first fixing hole 11 of a horizontal side pipe 10, a third fixing hole 33 on a horizontal portion 31 of a T-shaped pipe joint 30, and a fourth fixing hole 52 of a sheath 50, such that the horizontal side pipe 10, the T-shaped pipe joint 30 and the sheath 50 are correspondingly and fixedly connected to each other.

Moreover, the pin 60 can also be inserted, respectively, into a second fixing hole 22 of a connecting portion 21 of a support pipe 20, a third fixing hole 33 on a perpendicular portion 32 of the T-shaped pipe joint 30, and a fourth fixing hole 52 of the sheath 50, such that the support pipe 20, the T-shaped pipe joint 30 and the sheath 50 are correspondingly and fixedly connected to each other.

Further preferably, the pin 60 comprises a pin body 61, a top cover 62 and a protrusion 63. The pin body 61 is cylindrical, and the lower end is provided with at least two branches 64. The top cover 62 is provided at the top of said pin body 61, and has an edge extending outward. The protrusion 63 is arranged outside tail ends of the two branches 64.

In addition, the pin 60 further comprises a bowl-shaped water retaining piece 70, a through hole is provided on the water retaining piece 70, such that the pin body 61 can be inserted into said through hole; the bowl-shaped water retaining piece 70 is arranged between the top cover 62 of the pin 60 and an outer surface of the horizontal side pipe 10, and the bowl-shaped water retaining piece 70 can be selected from materials such as an elastic PVC or rubber.

In particular, the first end of the sheath body 51 is provided with a first annular limiting ring 54 which extends outward and is connected to an outer surface of the sheath body 51. The second end of the sheath body 51 is provided with a second annular limiting ring 55 which extends inward and is connected to an inner surface of the sheath body 51. The first annular limiting ring 54 can limit the installation position of the sheath 50 and the T-shaped pipe joint 30. The second annular limiting ring 55 can limit the installation position of the connecting portion 11 of the horizontal side pipe 10 and the sheath 50.

In the above structure, the radial cross-sections of the horizontal side pipe 10, the support pipe 20 and the T-shaped pipe joint 30 are preferably selected from one of a circular shape, an elliptical shape, and a D shape.

Embodiment II

Figure 11:
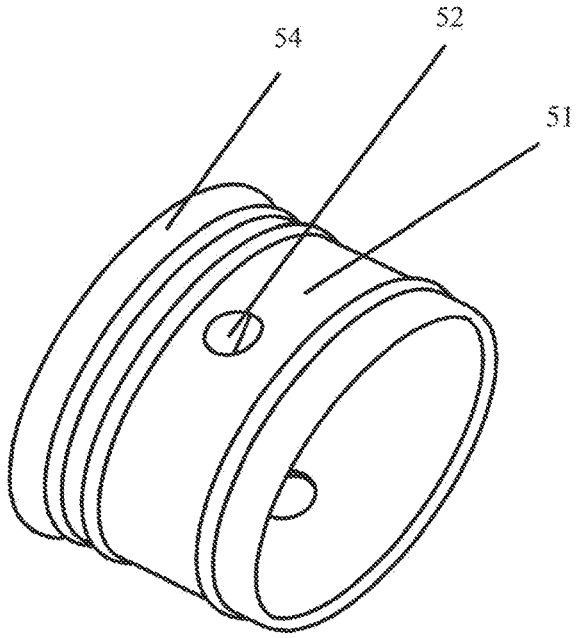
FIG. 11 is a perspective view of a sheath in embodiment II of a sheathed frame pool of the present invention.
Figure 12:
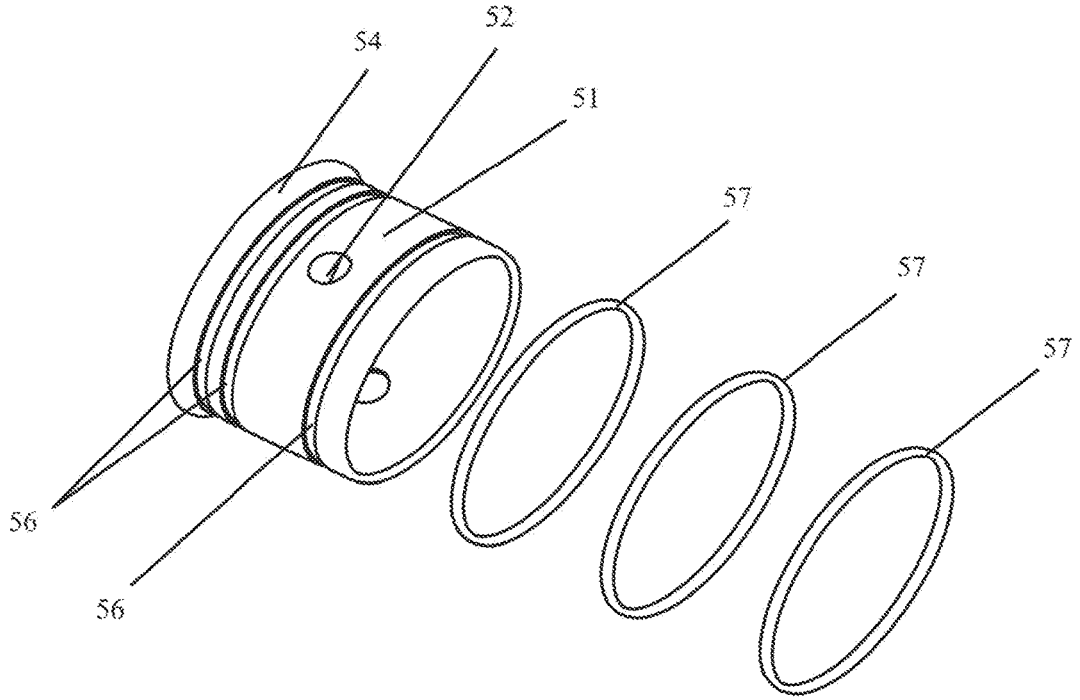
FIG. 12 is an exploded schematic view of a sheath in embodiment II of a sheathed frame pool of the present invention.
Figure 13:
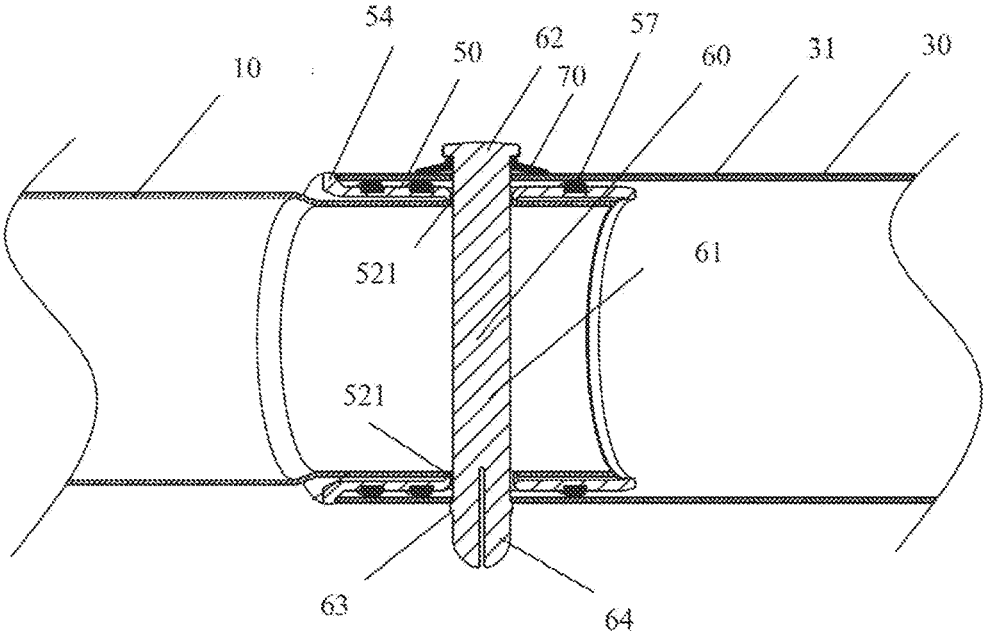
FIG. 13 is a sectional view of the junction of a horizontal side pipe and a T-shaped pipe joint in embodiment II of a sheathed frame pool of the present invention.

FIG. 11 is a perspective view of a sheath in embodiment II of a sheathed frame pool of the present invention. FIG. 12 is an exploded schematic view of a sheath in embodiment II of a sheathed frame pool of the present invention. FIG. 13 is a sectional view of the junction of a horizontal pipe and a T-shaped pipe joint in embodiment II of a sheathed frame pool of the present invention.

As shown in FIG. 11 to FIG. 13, the structure of the present embodiment is substantially same as the structure of embodiment I, and the difference lies in that the ring structure of the sheath 50 is preferably an O-shaped ring 57. In particular, at least one ring groove 56 is arranged at an outer surface of the sheath body 51, the O-shaped ring 57 is at least partially embedded into the annular groove 56, the O-shaped ring 57 is above the outer surface of the sheath body 51, and at the same time, the O-shaped ring 57 can also stop water from entering a gap between an outer surface of the connecting portion 11 of the horizontal side pipe 10 and an inner surface of the T-shaped pipe joint 30, thereby preventing the interior of the pipe body from getting rusted from moisture.

Embodiment III

Figure 14:
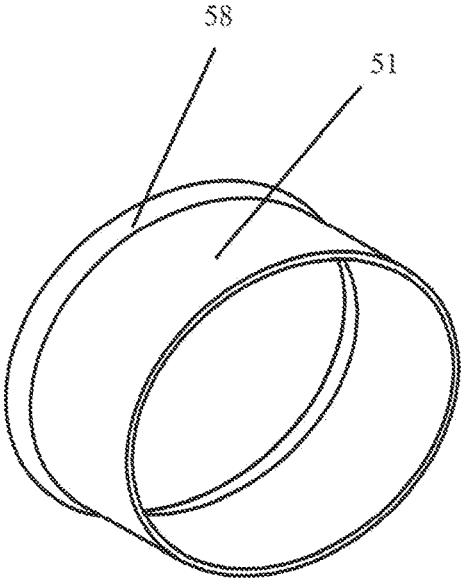
FIG. 14 is a perspective view of a sheath in embodiment III of a sheathed frame pool of the present invention.
Figure 15:
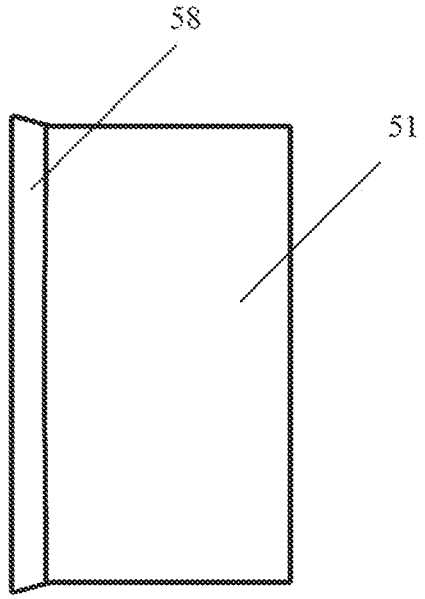
FIG. 15 is a front view of a sheath in embodiment III of a sheathed frame pool of the present invention.
Figure 16:
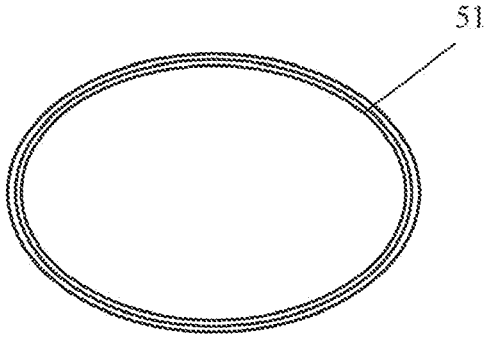
FIG. 16 is a right view of a sheath in embodiment III of a sheathed frame pool of the present invention.
Figure 17:
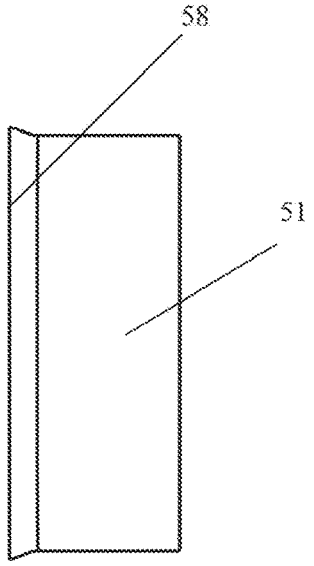
FIG. 17 is a top view of a sheath in embodiment III of a sheathed frame pool of the present invention.
Figure 18:
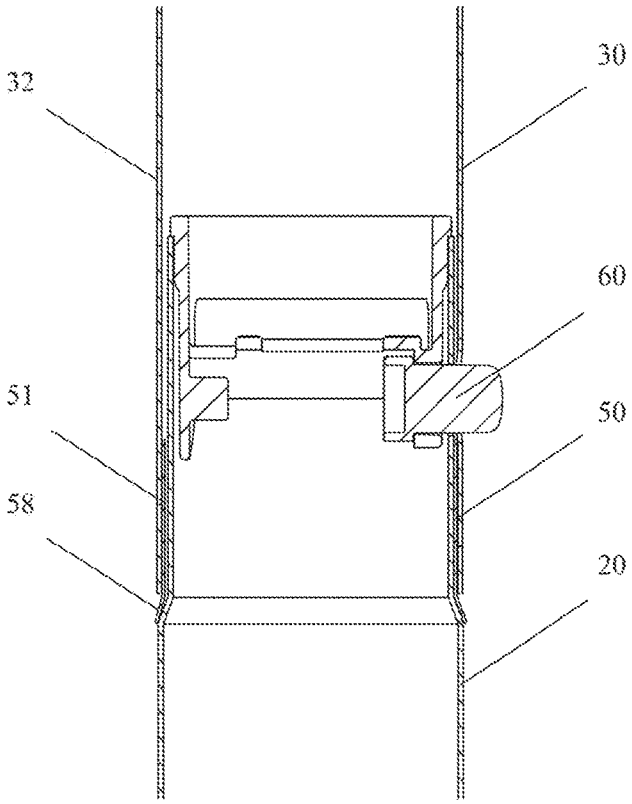
FIG. 18 is a sectional view of the junction of a T-shaped pipe joint and a support pipe in embodiment III of a sheathed frame pool of the present invention.

FIG. 14 is a perspective view of a sheath in embodiment III of a sheathed frame pool of the present invention. FIG. 15 is a front view of a sheath in embodiment III of a sheathed frame pool of the present invention. FIG. 16 is a right view of a sheath in embodiment III of a sheathed frame pool of the present invention. FIG. 17 is a top view of a sheath in embodiment III of a sheathed frame pool of the present invention. FIG. 18 is a sectional view of the junction of a T-shaped pipe joint and a support pipe in embodiment III of a sheathed frame pool of the present invention.

As shown in FIG. 11 to FIG. 13, the structure of the present embodiment and the structure of embodiment I are substantially the same, and the difference lies in that a sheath of another structural form is formed between the support pipe 20 and the T-shaped pipe joint 30. Specifically, the sheath 50 comprises a sheath body 51 and an extension portion 58. The sheath body 51 is of a hollow pipe structure. The upper end of the extension portion 58 is connected to the lower end of the sheath body 51, and the size of the extension portion 58 gradually increases from top to bottom. In particular embodiments, at least one fourth fixing hole (not shown in the figure) is provided at the pipe wall of the sheath body 51. In this structure, a pin 60 is used to be inserted into the fourth fixing hole on the sheath body 51 and the third fixing hole 33 of the perpendicular portion 32 of the T-shaped pipe joint 30 so as to fix the support pipe 20 and the T-shaped pipe joint 30 as a whole. In the embodiment of FIG. 18, the pin 10 is an elastic pin arranged in the support pipe. In the particular embodiments, pins of other structure can be selected.

In summary, the sheathed frame pool of the present invention has a simple structure, a low cost and convenient installation. Sheaths are respectively provided at the junction of a horizontal side pipe and a T-shaped pipe joint of the frame pool and the junction of a support pipe and the T-shaped pipe joint, which can effectively overcome the defect of rust generation on the pipe body caused by the susceptibility to wear of the coating at an outer surface of the horizontal side pipe and the support pipe due to frequent frictions between the horizontal side pipe and the T-shaped pipe joint and between the support pipe and the T-shaped pipe joint during the installation or use of frame pools in the prior art.

In addition, one or more ring structures are provided on the sheath, which can stop water from flowing into the interior of the pipe body from gaps between the horizontal side pipe, the support pipe and the T-shaped pipe joint, which can effectively prevent the pipe body from getting rusted from moisture, and can greatly prolong the service life of the frame pool.

While the particular embodiments of the present invention have been described, a person skilled in the art should understand that these are merely illustrative, and that the scope of protection of the present invention is defined by the appended claims. Various alterations or modifications can be made by a person skilled in the art to these embodiments without departing from the principle and substance of the present invention; however, these alterations and modifications all fall within the scope of protection of the present invention.

What is claimed is:

1. A sheathed frame pool, comprising:

a support frame comprising a plurality of interconnected support components, wherein the plurality of interconnected support components comprise:

a plurality of horizontal side pipes, each of the horizontal side pipes comprising two ends, each of the two ends comprising a horizontal connecting portion;

a plurality of support pipes, an upper end of each of the support pipes comprising a vertical connecting portion; and a plurality of T-shaped pipe joints, each of the T-shaped pipe joints comprising a horizontal portion and a perpendicular portion, the horizontal portion comprising two ends, the perpendicular portion being disposed on a lower end of each T-shaped pipe joint and being connected to the horizontal portion, wherein, each horizontal side pipe is connected between the adjacent two T-shaped pipe joints to form a upper frame structure by the horizontal connecting portion being inserted into the horizontal portion, wherein, each support pipe is connected to each T-shaped pipe joint to support the upper frame structure by the vertical connecting portion being inserted into the perpendicular portion, and wherein, the sheath is disposed on a horizontal junction of connecting the horizontal connecting portion and the horizontal portion and on a vertical junction of connecting the vertical connecting portion and the perpendicular portion, and a plurality of sleeves are disposed on a upper edge of the pool liner for disposing the pool liner on the upper frame structure;

at least one first fastened hole disposed on the horizontal connecting portion, at least one second fastened hole disposed on the vertical connecting portion, at least one third fastened hole disposed on the two ends of horizontal portion and the perpendicular portion respectively;

a pool liner comprising a pool bottom and a pool wall connected to an outer edge of the pool bottom and extending upward, an upper side of the pool wall hanging on the support frame and bei-Rg disposed on an inside of the support frame; and at least one sheath disposed on a junction between at least two of the plurality of interconnected support components, wherein the sheath comprises:

a sheath body, the sheath body being a hollow pipe structure;

at least one fourth fastened hole, the least one fourth fastened hole being disposed on a pipe wall of the sheath body; and at least one ring structure disposed on an outer surface of the sheath body.

2. The sheathed frame pool as claimed in claim 1, wherein the sheath is at least partially disposed between an inner surface of the horizontal portion and an outer surface of the horizontal connecting portion.

3. The sheathed frame pool as claimed in claim 1, wherein the sheath is at least partially disposed between an inner surface of the perpendicular portion and an outer surface of the vertical connecting portion.

4. The sheathed frame pool as claimed in claim 1, further comprising an annular fixing ring disposed on an edge of the fourth fastened hole the annular fixing ring being extended inwardly on the fourth fastened hole, the annular fixing ring being at least partially inserted into the first fastened hole.

5. The sheathed frame pool as claimed in claim 1, wherein the ring structure is an annular convex rib connected to the sheath body, the annular convex rib being higher than the outer surface of the sheath body.

6. The sheathed frame pool as claimed in claim 1, wherein the ring structure is of an O-shaped ring.

7. The sheathed frame pool as claimed in claim 6, wherein the outer surface of the sheath body comprising at least one annular groove, the O-shaped ring is at least partially embedded in the annular groove, and the O-shaped ring is disposed above the outer surface of the sheath body.

8. The sheathed frame pool as claimed in claim 1, wherein a first end of the sheath body comprises a first annular limiting ring extending outwardly and being connected to the outer surface of the sheath body.

9. The sheathed frame pool as claimed in claim 1, wherein a second end of the sheath body comprises a second annular limiting ring extending inwardly and being connected to an inner surface of the sheath body.

10. The sheathed frame pool as claimed in claim 2, wherein the sheath comprises an extension portion, an upper end of the extension portion being connected to a lower end of the sheath body, a size and width of the extension portion gradually increasing from an top side to bottom side of the extension portion.

11. The sheathed frame pool as claimed in claim 1, further comprising a plurality of pins dispose on the interconnected support components, each of the pins being drilled through the first fastened hole, the third fastened hole and the fourth fastened hole to correspondingly fasten the horizontal side pipe, the T-shaped pipe joint and the sheath.

12. The sheathed frame pool as claimed in claim 11, wherein the pins drill through the second fastened hole, the third fastened hole, and the fourth fastened hole to correspondingly fasten the horizontal side pipe, the T-shaped pipe joint and the sheath.

13. The sheathed frame pool as claimed in claim 12, wherein each of the pins comprises:

a pin body, the pin body being cylinder, and comprising at least two branches disposed on a lower end of the pin body;

a cover disposed on a top portion of the pm body and comprising an edge extending outwardly; and a protrusion disposed on an outer side of the branches in tail ends.

14. The sheathed frame pool as claimed in claim 13, wherein each of the pins comprises a bowl-shaped water retaining piece, the water retaining piece comprising a through hole, the pin body being inserted into the through hole, the bowl-shaped water retaining piece being disposed between the cover of the pin and an outer surface of the horizontal portion of the T-shaped pipe joint.

* * * * *